US005547592A

United States Patent [19]

Nakagawa et al.

[11] Patent Number: 5,547,592

[45] Date of Patent: Aug. 20, 1996

[54] LUBRICANT FOR METALLURGY

[75] Inventors: Kenichi Nakagawa; Michiyoshi Sugioka; Koichi Ito, all of Urawa, Japan

[73] Assignee: Asahi Denka Kogyo Kabushiki Kaisha, Tokyo, Japan

[21] Appl. No.: 172,246

[22] Filed: Dec. 23, 1993

Related U.S. Application Data

[63] Continuation of Ser. No. 820,989, Jan. 15, 1992, abandoned.

[51] Int. Cl.[6] ..... C10M 135/22; C10M 129/42

[52] U.S. Cl. ..... 508/511; 508/506

[58] Field of Search ..... 252/34, 41, 45, 252/42, 47, 47.5, 34.7, 42.1, 46.4, 48.6, 49.3, 49.5, 40, 40.5; 72/42; C10M 135/22, 129/42

[56] References Cited

U.S. PATENT DOCUMENTS

| | | | |
|---|---|---|---|
| 3,618,707 | 11/1971 | Sluhan | 72/42 |
| 4,264,458 | 4/1981 | Campbell et al. | 252/45 |
| 4,589,992 | 5/1986 | Phillips et al. | 252/34 |
| 4,659,490 | 4/1987 | Louthan et al. | 252/47.5 |

FOREIGN PATENT DOCUMENTS

| | | |
|---|---|---|
| 61-181896 | 8/1986 | Japan . |
| 1439899 | 6/1976 | United Kingdom . |

*Primary Examiner*—Prince Willis, Jr.
*Assistant Examiner*—Alan D. Diamond
*Attorney, Agent, or Firm*—Young & Thompson

[57] ABSTRACT

A lubricant for metal working comprising a dicarboxylic acid represented by the following general formula (I) or its amine salt or its alkali metal salt and a sulfur extreme pressure agent:

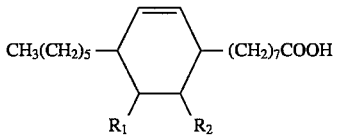

(I)

wherein $R_1$ stands for COOH or H; and $R_2$ stands for H when $R_1$ is COOH and COOH when $R_1$ is H.

12 Claims, No Drawings

LUBRICANT FOR METALLURGY

This application is a continuation of application Ser. No. 07/820,989, filed Jan. 15, 1992, now abandoned.

BACKGROUND OF THE INVENTION

1. Field of Industrial Application

The present invention relates to a lubricant for metallurgy (metal working). More particularly, the present invention is concerned with a lubricant for use in metal working such as cutting, grinding, drawing and wire drawing, which comprises a particular dicarboxylic acid or its amine salt or its alkali metal salt and a sulfur extreme-pressure agent.

2. Description of the Prior Art

In lubricants used for metal working, such as cutting, grinding, drawing, wire drawing, pressing, etc., an oiliness improver, an extreme pressure agent, a rust preventive, a surfactant, a preservative, an antioxidant, etc., are added to a vegetable or animal oil or fat, a mineral oil, a synthetic oil or a mixture thereof or water, and the mixture is used as such or in the form of a 1 to 30% emulsion or an aqueous solution. In recent years, with an increase in the size of various working machines, an increase in the precision and the hardness of metal materials, an increase in the speed and pressure in working conditions, an increase in the precision of a finished surface, etc., the working conditions have become more and more severe, so that the conventional lubricants for metallurgy have become impossible to cope with the use under severe conditions. For this reason, the addition of chlorine- and sulfur-containing extreme-pressure agents has become indispensable.

In recent years, however, a fear for the toxicity and carcinogenicity of the organochlorine compounds has remarkably increased. Further, a non-chlorinated lubricant has become thought to be desired also from the viewpoint of a rise in the environmental pollution problem.

Since, however, non-chlorinated lubricants which have been developed and are currently in the market (for example, JIS W No. 1, first class and JIS W No. 2, second class) are free from an extreme-pressure agent, they are unsatisfactory for use in plastic working such as high-speed and heavy cutting and drawing. Japanese Patent Laid-Open No. 181896/1986 discloses a water-soluble cutting oil containing polysulfide, and Japanese Patent Laid-Open Nos. 149997/1983 and 139791/1985 disclose a water-soluble cutting oil containing an amine salt or an alkali metal salt of a monoester, such as an adduct of a dicarboxylic acid represented by the following general formula (I) with polyoxypropylene glycol, polyoxyethylene glycol, polyoxypropylene or the like.

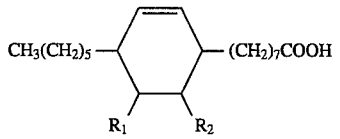

(I)

wherein $R_1$ stands for COOH or H; and $R_2$ stands for H when $R_1$ is COOH, and COOH when $R_1$ is H. These water-soluble cutting oils, however, are not yet satisfactory for use in high-speed and heavy cutting from the viewpoint of the precision and service life of the tool.

Examples of the non-chlorinated lubricating additive known in the art include a product of a reaction of an organic amine with an organic phosphoric ester or an organic phosphorous ester (see U.S. Pat. No. 3,553,131) and a product of a reaction of a dihydrocarbyl phosphite having 1 to 6 carbon atoms with an alkoxyamine or a vicinal diol or a product of a reaction of the dihydrocarbyl phosphite with a boron compound (diboron trioxide, boric acid, metaborate, alkyl borate or the like) (see U.S. Pat. Nos. 4,529,528, 4,557,845, 4,555,353, 4,532,057, and 4,522,629). They, however, lack in the extreme-pressure property for use as an additive of a lubricant for metallurgy. Japanese Patent Laid-Open No. 308495/1989 discloses a product of a reaction of an alkoxylated amine with an organic phosphite, a product of a reaction of an alkoxylated amine with an organic phosphite and a boron-containing compound (diboron trioxide, metaborate or an organic boron compound), etc. These reaction products, however, are not yet satisfactory in the improvement of the effect, and a further improvement has been desired in the art.

SUMMARY OF THE INVENTION

Under the above-described circumstances, the present inventors have made extensive and intensive studies with a view to providing a lubricant for metal working which is excellent in the cutting property, grinding property and plastic working property as well as in the putrefaction resistance, deterioration resistance and anti-foaming property and, as a result, have found that a lubricant for metal working comprising a dicarboxylic acid represented by the following general formula (I) or its amine salt or its alkali metal salt and a sulfur extreme pressure agent can attain the above-described object:

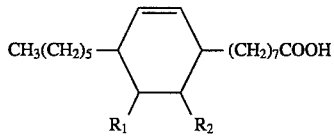

(I)

wherein $R_1$ stands for COOH or H; and $R_2$ stands for H when $R_1$ is COOH, and COOH when $R_1$ is H.

DETAILED DESCRIPTION OF THE INVENTION

The dicarboxylic acid represented by the general formula (I) or its alkali metal salt or its amine salt can be added to a mineral oil or/and a synthetic oil together with a sulfur extreme-pressure agent, an oiliness improver, a rust preventive, etc., and the resultant mixture can be used as a water-insoluble lubricant for metal working. Alternatively, it can be added to water or a mineral oil or/and a synthetic oil together with a sulfur extreme-pressure agent, a surfactant, a rust preventive, a preservative, etc., and a lubricant composition for metal working of an emulsion type or a soluble type is prepared from the resultant mixture by the conventional means. In this case, a useful proportion of addition of the compound is properly selected according to the kind of the additives used in combination with the compound, the purpose of use of the lubricant and the condition of use of the lubricant.

Examples of the alkali metal in the alkali metal salt or amine salt of the dicarboxylic acid represented by the general formula (I) include lithium, sodium and potassium, and sodium or potassium is preferred from the practical viewpoint. Various amine compounds which have been used as an amine salt in a water-soluble cutting lubricant can be used as an amine for forming the amine salt. Examples of the amine compound include alkylamines such as tributylamine, 2-ethylhexylamine, stearylamine, dimethylstearylamine, ethylene oxide adducts of these alkylamines, alkanolamines such as diethanolamine, triethanolamine and diisopropanolamine, dicyclohexylamine, morpholine and N-aminopropylmorpholine, and alkanolamines are particularly useful.

The alkali metal salt or amine salt of the dicarboxylic acid represented by the general formula (I) can be easily produced by adding to the dicarboxylic acid an alkali metal hydroxide or an amine in slight excess of the neutralization equivalent and is preferred also from the viewpoint of the rust preventing property and deterioration resistance.

The amount of incorporation of the dicarboxylic acid represented by the general formula (I) or its alkali metal salt or its amine salt is preferably 1 to 40% by weight, still preferably 3 to 35% by weight.

Examples of the sulfur extreme-pressure agent used in the present invention include vulcanized oils and fats (vulcanized rapeseed oil, vulcanized lard, vulcanized synthetic sperm oil, etc.), polysulfides (an ester of dibenzyl monosulfide, dibenzyl disulfide, dibenzyl octasulfide, di-tert-dodecyl polysulfide, di-tert-nonyl polysulfide, dihexadecyl polysulfide or diethanol disulfide with a fatty acid, etc.) and thiocarbonates (a glycol ester of xanthogen disulfide, xanthogen tetrasulfide or xanthic acid), and polysulfides, that is, di-tert-dodecyl polysulfide, di-tert-nonyl polysulfide, etc., are preferred.

The amount of incorporation of the above-described sulfur extreme pressure agent is preferably 1 to 30% by weight, still preferably 5 to 20% by weight.

Examples of the mineral oil used in the present invention include refined mineral oils, such as machine oil and turbine oil, and examples of the synthetic oil include synthetic hydrocarbon oils such as poly-α-olefin oil and polypentadiene oil, ester oils such as a fatty acid pentaerythritol ester and dioctyl sebacate and polyether polyol.

Examples of the rust preventive used in the present invention include a calcium salt of a petroleum sulfonic acid, a barium salt of a petroleum sulfonic acid, a sodium salt of a petroleum sulfonic acid, sorbitan monooleate, lanolin, a calcium salt of oxidized wax, a barium salt of oxidized wax, a sodium salt of oxidized wax, an alkoxyphenylamine, dicyclohexylamine, pentaerythritol monoester, an alkanolamine, an alkylimidazoline, oleylsarcosine, and oleylamine oleate.

Examples of the surfactant used in the present invention include a potassium soap of a petroleum sulfonic acid, a sodium soap of a petroleum sulfonic acid, an alkylsulfamide carboxylate, octylphenol ethoxylate, nonylphenol ethoxylate, a $C_{12-18}$ alcohol ethoxylate and 2:1 diethanolamine fatty acid amide.

The present invention will now be described in more detail with reference to the following Examples and Comparative Examples. It, however, is not limited to these Examples only.

EXAMPLE 1

Water-insoluble cutting oils respectively having compositions specified in the following Table 1 were prepared and subjected to a load wear index (LWI) (ASTM D-2783) test through the use of a shell type high-speed four-ball tester. The results are given in Table 1.

The amount of addition in the table is part by weight unless otherwise specified.

TABLE 1

| | Comp. Ex. | | | Ex. | | |
|---|---|---|---|---|---|---|
| | 1-1 | 1-2 | 1-3 | 1-1 | 1-2 | 1-3 |
| mineral oil | 90 | 90 | 90 | 90 | 90 | 90 |
| rapeseed oil | 3 | 3 | 3 | 3 | 3 | 3 |
| TEA salt of DA-1550 *1 | | | 7 | 3 | 3 | 3 |
| chlorinated paraffin (Cl: 45%) | 7 | 3 | | | | |
| di-tert-nonyl trisulfide | | 4 | | 4 | | |
| di-tert-dodecyl trisulfide | | | | | 4 | |
| di-tert-dodecyl tetrasulfide | | | | | | 4 |
| pressure resistance (lb) | 22.0 | 23.0 | 18.5 | 26.5 | 26.0 | 26.5 |

Note)

*1: Trade name of $CH_3(CH_2)_5$ 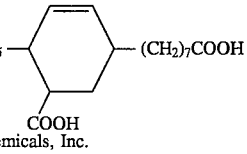 $(CH_2)_7COOH$

COOH manufactured by Harima Chemicals, Inc.

EXAMPLE 2

Emulsion type grinding and cutting oils respectively having compositions specified in the following Tables 3 (a), (b) and (c) were produced and subjected to measurement of the coefficient of friction at 25° C. through the use of a Model N2 Soda pendulum oiliness tester, and a putrid smell after standing for 7 days. Further, a rust preventive property was measured by a method which comprises immersing a dry cutting chip of a casting in emulsion type cutting oils respectively having compositions specified in Tables 3 (a), (b) and (c) for 24 hr, removing the cutting oils, placing the chip in a Petri dish and observing the state of occurrence of rust 72 hr after the placement. A cutting test was conducted by measuring the number of holes necessary for the torque value to become 10 kw in a drill press. The cutting conditions are specified in Table 2, and the test results are given in Tables 3 (a), (b) and (c).

TABLE 2

| | | |
|---|---|---|
| machine | HDP-500 | |
| tool | carbide drill (16 mmϕ) | |
| material of workpiece | SS41 | |
| plate thickness | 35 mm | |
| cutting speed | number of revolutions: | 850 rpm |
| | feed: | 0.28 |

TABLE 3(a)

| | Comp. Ex. | | |
|---|---|---|---|
| | 2-1 | 2-2 | 2-3 |
| mineral oil | 67.5 | 67.5 | 70.5 |
| Na petroleum sulfonate | 5 | 5 | 5 |
| nonylphenol surfactant | 8 | 8 | 8 |
| preservative | 0.5 | 0.5 | 0.5 |
| triethanolamine | 6 | 6 | 6 |
| oleic acid | 3 | 3 | |
| DA-1550 | | | 10 |
| Na salt of DA-1550 | | | |
| chlorinated-paraffin (Cl: 45%) | | 5 | |
| product of reaction of amine with phosphite and boric acid*1 | 10 | | |
| vulcanized synthetic sperm oil | | 5 | |

TABLE 3(a)-continued

| | Comp. Ex. | | |
|---|---|---|---|
| | 2-1 | 2-2 | 2-3 |
| di-tert-nonyl trisulfide | | | |
| di-tert-nonyl tetrasulfide | | | |
| di-tert-dodecyl trisulfide | | | |
| di-tert-dodecyl pentasulfide | | | |
| 10% emulsion of the above composition | | | |
| coefficient of friction (μ) | 0.14 | 0.13 | 0.12 |
| putrid smell after 7 days | slight | slight | free |
| rust preventive property | Δ | x | o |
| surface tension (dyne/cm) | 40 | 40 | 37 |
| tool life (number of holes) | 70 | 90 | 60 |

Note)
*[1]a product of a reaction of equimolar amounts of bis(2-hydroxypropyl)tallowamine, di(2-ethylhexyl)phosphite and boric acid.

TABLE 3(b)

| | Ex. | | |
|---|---|---|---|
| | 2-1 | 2-2 | 2-3 |
| mineral oil | 70.5 | 70.5 | 70.5 |
| Na petroleum sulfonate | 5 | 5 | 5 |
| nonylphenol surfactant | 8 | 8 | 8 |
| preservative | 0.5 | 0.5 | 0.5 |
| triethanolamine | 6 | 6 | 6 |
| oleic acid | | | |
| DA-1550 | 5 | 5 | 5 |
| Na salt of DA-1550 | | | |
| chlorinated paraffin (Cl: 45%) | | | |
| product of reaction of amine with phosphite and boric acid*[1] | | | |
| vulcanized synthetic sperm oil | 5 | | |
| di-tert-nonyl trisulfide | | 5 | |
| di-tert-nonyl tetrasulfide | | | 5 |
| di-tert-dodecyl trisulfide | | | |
| di-tert-dodecyl pentasulfide | | | |
| 10% emulsion of the above composition | | | |
| coefficient of friction (μ) | 0.12 | 0.12 | 0.12 |
| putrid smell after 7 days | free | free | free |
| rust preventive property | o | o | o |
| surface tension (dyne/cm) | 39 | 40 | 39 |
| tool life (number of holes) | 300 or more | 300 or more | 300 or more |

Note)
*[1]a product of a reaction of equimolar amounts of bis(2-hydroxypropyl)tallowamine, di(2-ethylhexyl)phosphite and boric acid.

TABLE 3(c)

| | Ex. | | | |
|---|---|---|---|---|
| | 2-4 | 2-5 | 2-6 | 2-7 |
| mineral oil | 70.5 | 70.5 | 70.5 | 70.5 |
| Na petroleum sulfonate | 5 | 5 | 5 | 5 |
| nonylphenol surfactant | 8 | 8 | 8 | 8 |
| preservative | 0.5 | 0.5 | 0.5 | 0.5 |
| triethanolamine | 6 | 6 | 6 | 6 |
| oleic acid | | | | |
| DA-1550 | 5 | 5 | | |
| Na salt of DA-1550 | | | 5 | 5 |
| chlorinated paraffin (Cl: 45%) | | | | |
| product of reaction of amine with phosphite and boric acid*[1] | | | | |
| vulcanized synthetic sperm oil | | | 5 | |
| di-tert-nonyl trisulfide | | | | |
| di-tert-nonyl tetrasulfide | | | | |
| di-tert-dodecyl trisulfide | 5 | | | 5 |
| di-tert-dodecyl pentasulfide | | 5 | | |
| 10% emulsion of the above composition | | | | |
| coefficient of friction (μ) | 0.12 | 0.12 | 0.12 | 0.12 |

TABLE 3(c)-continued

| | Ex. | | | |
|---|---|---|---|---|
| | 2-4 | 2-5 | 2-6 | 2-7 |
| putrid smell after 7 days | free | free | free | free |
| rust preventive property | o | o | o | o |
| surface tension (dyne/cm) | 40 | 40 | 38 | 38 |
| tool life (number of holes) | 300 or more | 300 or more | 300 or more | 300 or more |

Note)
*[1]a product of a reaction of equimolar amounts of bis(2-hydroxypropyl)tallowamine, di(2-ethylhexyl)phosphite and boric acid.

EXAMPLE 3

Soluble type cutting oils respectively having compositions specified in the following Tables 4 were produced and subjected to measurement of the coefficient of friction at 25° C. through the use of a Model N2 Soda pendulum oiliness tester and a cutting test in the same manner as that of the Example 2. The results are given in Table 4.

In Table 4, DIPA salt represents a diisopropanolamine salt, and TEA salt represents a triethanolamine salt.

TABLE 4

| | Comp. Ex. | | | Ex. | | |
|---|---|---|---|---|---|---|
| | 3-1 | 3-2 | 3-3 | 3-1 | 3-2 | 3-3 |
| Na petroleum sulfonate | 5 | 5 | 5 | 5 | 5 | 5 |
| TEA salt of ricinolic acid | 30 | | 30 | | | |
| TEA salt of polyoxypropylene glycol monoester of DA-1550 nonylphenol surfactant | | 30 | | | | |
| Na salt of DA-1550 | | | | 30 | | |
| DIPA salt of DA-1550 | | | | | 30 | |
| TEA salt of DA-1550 | | | | | | 30 |
| chlorinated paraffin (Cl: 45%) | 10 | 10 | | | | |
| di-tert-nonyl trisulfide | | | | 10 | 10 | 10 |
| di-tert-nonyl tetrasulfide | | | | | | |
| product of reaction of amine with phosphite and boric acid | | | 10 | | | |
| caprylic acid | 4.5 | 4.5 | 4.5 | 4.5 | 4.5 | 4.5 |
| preservative | 0.5 | 0.5 | 0.5 | 0.5 | 0.5 | 0.5 |
| water | 50 | 50 | 50 | 50 | 50 | 50 |
| 10% emulsion of the above composition | | | | | | |
| coefficient of friction (μ) | 0.15 | 0.18 | 0.13 | 0.12 | 0.12 | 0.12 |
| tool life (number of holes) | 70 | 80 | 90 | 150 | 180 | 170 |

As exemplified above, it is possible to provide a non-chlorinated lubricant for metal working having an excellent cutting property, no odor and excellent putrefaction and deterioration resistances through the use of a dicarboxylic acid or its amine salt or its alkali metal salt and a sulfur extreme-pressure agent.

What is claimed is:

1. A lubricant for metal working comprising 1 to 40% by weight of a dicarboxylic acid represented by the following general formula (I) or its amine salt or its alkali metal salt, 1 to 30% by weight of a dialkyl polysulfide compound as a sulfur extreme pressure agent:

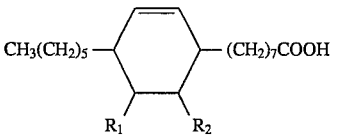

(I)

wherein $R_1$ stands for COOH or H; and $R_2$ stands for H when $R_1$ is COOH and COOH when $R_1$ is H, and the balance predominantly at least one member selected from the group consisting of water, mineral oil and synthetic oil.

2. A lubricant according to claim 1, which contains the acid form of the dicarboxylic acid represented by the general formula (I).

3. A lubricant according to claim 2, which further contains an amine.

4. A lubricant according to claim 3, wherein the amine is an alkanolamine compound.

5. A lubricant according to claim 1, which contains the amine salt of the dicarboxylic acid represented by the general formula (I).

6. A lubricant according to claim 5, wherein the amine for forming said amine salt is an alkanolamine compound.

7. A lubricant according to claim 1, wherein the dialkyl polysulfide compound is selected from the group consisting of di-tert-nonyl-trisulfide, di-tert-nonyl-tetrasulfide, di-tert-butyl-trisulfide, and di-tert-dodecyl-trisulfide.

8. A lubricant according to claim 1, which is free from a chlorinated extreme-pressure agent.

9. A lubricant according to claim 1, which is a water-insoluble lubricant.

10. A lubricant according to claim 1, which is a water-soluble lubricant.

11. A lubricant according to claim 1, wherein said member is mineral oil.

12. An emulsion composition containing the lubricant according to claim 1.

* * * * *